US011673149B2

(12) United States Patent
Fritz et al.

(10) Patent No.: US 11,673,149 B2
(45) Date of Patent: Jun. 13, 2023

(54) APPLICATOR WITH A SMALL NOZZLE DISTANCE

(71) Applicant: Dürr Systems AG, Bietigheim-Bissingen (DE)

(72) Inventors: Hans-Georg Fritz, Ostfildern (DE); Benjamin Wöhr, Eibensbach (DE); Marcus Kleiner, Besigheim (DE); Mortiz Bubek, Ludwigsburg (DE); Timo Beyl, Besigheim (DE); Frank Herre, Oberriexingen (DE); Steffen Sotzny, Oberstenfeld (DE); Daniel Tandler, Stuttgart (DE); Tobias Berndt, Ditzingen (DE)

(73) Assignee: DÜRR SYSTEMS AG, Bietigheim-Bissingen (DE)

( * ) Notice: Subject to any disclaimer, the term of this patent is extended or adjusted under 35 U.S.C. 154(b) by 307 days.

(21) Appl. No.: 16/649,217

(22) PCT Filed: Sep. 20, 2018

(86) PCT No.: PCT/EP2018/075504
§ 371 (c)(1),
(2) Date: Mar. 20, 2020

(87) PCT Pub. No.: WO2019/063417
PCT Pub. Date: Apr. 4, 2019

(65) Prior Publication Data

US 2020/0298254 A1 Sep. 24, 2020

(30) Foreign Application Priority Data

Sep. 27, 2017 (DE) ..... 10 2017 122 493.9

(51) Int. Cl.
*B05B 1/16* (2006.01)
*B05B 15/18* (2018.01)
(Continued)

(52) U.S. Cl.
CPC ..... *B05B 1/1609* (2013.01); *B05B 1/306* (2013.01); *B05B 1/3053* (2013.01); *B05B 15/18* (2018.02);
(Continued)

(58) Field of Classification Search
CPC ..... B05B 1/1609; B05B 15/18; B05B 15/55; B05B 1/3053; B05B 1/306; B05B 1/3046;
(Continued)

(56) References Cited

U.S. PATENT DOCUMENTS 2,296,079 A 9/1942 Anderson
4,157,149 A 6/1979 Moen
(Continued)

FOREIGN PATENT DOCUMENTS

CN 1420070 A 5/2003
CN 101480642 A 7/2009
(Continued)

OTHER PUBLICATIONS

Machine Translation of DE3634137A1 Description, Espacenet, Jun. 2022, 5 Pages (Year: 2022).*
(Continued)

*Primary Examiner* — Joseph A Greenlund
*Assistant Examiner* — Kevin Edward Schwartz
(74) *Attorney, Agent, or Firm* — Bejin Bieneman PLC

(57) ABSTRACT

The disclosure concerns an applicator (e.g. printhead) for applying a coating agent (e.g. paint) to a component (e.g. motor vehicle body component), having at least one nozzle row with a plurality of nozzles for dispensing the coating agent in the form of a jet in each case, the nozzles being arranged along the nozzle row and in a common nozzle plane, and having a plurality of actuators for controlled release or closure of the nozzles. The disclosure provides that the individual actuators each have an outer dimension
(Continued)

along the nozzle row which is greater than a nozzle distance along the nozzle row.

24 Claims, 16 Drawing Sheets

(51) Int. Cl.
*B05B 15/55* (2018.01)
*B05B 1/30* (2006.01)
*B41M 7/00* (2006.01)

(52) U.S. Cl.
CPC ..... *B05B 15/55* (2018.02); *B41M 7/0018* (2013.01); *B05B 1/3046* (2013.01)

(58) Field of Classification Search
CPC .. B05B 1/14; B41M 7/0018; B41J 2/04; B41J 2/14; B41J 2/175; B41J 2/17596; B41J 2202/05
USPC ..... 239/106; 118/411
See application file for complete search history.

(56) References Cited

U.S. PATENT DOCUMENTS

| | | | | |
|---|---|---|---|---|
| 4,809,017 | A * | 2/1989 | Fost | B41J 2/04 118/313 |
| 4,998,502 | A * | 3/1991 | Schucker | F24H 1/10 118/667 |
| 5,022,629 | A * | 6/1991 | Tibbals, Jr. | B05B 1/3053 251/129.08 |
| 5,066,216 | A * | 11/1991 | Kowtko | B65B 3/10 425/562 |
| 5,769,947 | A | 6/1998 | Krappweis | |
| 5,800,614 | A | 9/1998 | Foust | |
| 6,371,603 | B1 | 4/2002 | Seto | |
| 6,776,360 | B2 * | 8/2004 | Haruch | B05B 15/5225 277/630 |
| 7,332,035 | B1 | 2/2008 | Tudor | |
| 7,357,485 | B2 * | 4/2008 | Silverbrook | B41J 2/1646 347/49 |
| 8,286,898 | B2 * | 10/2012 | Muljono | B05B 1/306 239/548 |
| 9,044,764 | B2 * | 6/2015 | Jochheim | B05C 5/0258 |
| 9,108,424 | B2 | 8/2015 | Frederick et al. | |
| 9,403,367 | B2 * | 8/2016 | Reder | B41J 2/16588 |
| 9,586,342 | B2 * | 3/2017 | Shaddock | B29C 31/041 |
| 10,016,977 | B2 * | 7/2018 | Stefani | B41J 2/1433 |
| 11,254,126 | B2 * | 2/2022 | Wang | B41J 2/045 |
| 2005/0046673 | A1 | 3/2005 | Silverbrook et al. | |
| 2008/0011227 | A1 | 1/2008 | Arnaboldi | |
| 2009/0079792 | A1 | 3/2009 | Koizumi | |
| 2012/0055178 | A1 | 3/2012 | Takahashi et al. | |
| 2013/0127955 | A1 | 5/2013 | Miyuki et al. | |
| 2015/0360472 | A1 | 12/2015 | Obertegger et al. | |

FOREIGN PATENT DOCUMENTS

| | | | |
|---|---|---|---|
| CN | 101553685 | A | 10/2009 |
| CN | 101616755 | A | 12/2009 |
| CN | 201415168 | Y | 3/2010 |
| CN | 104647903 | A | 5/2015 |
| CN | 106414081 | A | 2/2017 |
| CN | 106573258 | A | 4/2017 |
| DE | 2612614 | A1 | 10/1976 |
| DE | 3302617 | A1 | 8/1984 |
| DE | 3506393 | A1 | 8/1986 |
| DE | 3634137 | A1 | 4/1988 |
| DE | 69126667 | T2 | 1/1998 |
| DE | 102014013158 | A1 | 3/2016 |
| EP | 0276053 | A1 | 7/1988 |
| EP | 0426473 | A2 | 5/1991 |
| EP | 1862311 | A1 | 12/2007 |
| EP | 2055394 | A2 | 5/2009 |
| EP | 2646170 | B1 | 1/2015 |
| JP | S63-165147 | A | 7/1988 |
| JP | H05-293959 | A | 11/1993 |
| JP | 2001-146010 | A | 5/2001 |
| JP | 2008119554 | A | 5/2008 |
| JP | 2009-078398 | A | 4/2009 |
| JP | 2009106934 | A | 5/2009 |
| JP | 2011-514234 | A | 5/2011 |
| JP | 2013-107256 | A | 6/2013 |
| JP | 2015096322 | A | 5/2015 |
| WO | 92/07121 | A2 | 4/1992 |
| WO | 2007056098 | A2 | 5/2007 |
| WO | 2010046064 | A1 | 4/2010 |
| WO | 2010134153 | A1 | 11/2010 |
| WO | 2012058373 | A2 | 5/2012 |
| WO | 2012072576 | A1 | 6/2012 |
| WO | 2013140814 | A1 | 9/2013 |

OTHER PUBLICATIONS

Machine Translation of JPS63165147A Description, Oct. 2022, Espacenet, 6 Pages (Year: 2022).*
EPO Third Party Observations for Patent No. EP3687701 mailed Oct. 1, 2020 (7 pages).
International Search Report and Written Opinion for PCT/EP2018/075504 dated Dec. 7, 2018 (17 pages; with English translation).
International Search Report and Written Opinion for PCT/EP2018/076219 dated Jul. 12, 2018 (17 pages; with English translation).
Non-Final Office Action dated Dec. 24, 2021 for related U.S. Appl. No. 16/649,236 (27 pages).
Chinese Office Action for Application No. 201880062988.0 dated Feb. 26, 2021 (13 pages; with English translation of Search Report).
Chinese Office Action for Application No. CN201880063177.2 dated Mar. 29, 2021 (21 pages; with English machine translation).
Notification of Reasons for Rejection from the Japan Patent Office for related application No. JP2020-518041 dated Sep. 6, 2022 (12 pages; with English translation).
Notification of Reasons for Rejection from the Japan Patent Office for Application No. JP2020518024 dated Jul. 5, 2022 (9 pages; with English translation).

* cited by examiner

APPLICATOR WITH A SMALL NOZZLE DISTANCE

CROSS-REFERENCE TO RELATED APPLICATIONS

This application is a national stage of, and claims priority to, Patent Cooperation Treaty Application No. PCT/EP2018/075504, filed on Sep. 20, 2018, which application claims priority to German Application No. DE 10 2017 122 493.9, filed on Sep. 27, 2017, which applications are hereby incorporated herein by reference in their entireties.

FIELD

The disclosure concerns an applicator (e.g. a printhead) for the application of a coating agent (e.g. paint) to a component (e.g. car body component).

BACKGROUND

So-called drop-on-demand printheads are known from the state-of-the-art (e.g. U.S. Pat. No. 9,108,424 B2), which emit a droplet jet or a continuous coating agent jet, whereby the operating principle of these known drop-on-demand printheads is based on the use of electromagnetic valves. A magnetically driven piston is guided in a coil and moves a valve needle, which is shifted depending on the current applied to the coil and either releases or closes a nozzle.

Such printheads are also described in WO 2012/058373 A2. These well-known printheads also work with valve pistons, which are moved by electrical actuators, whereby the valve pistons run in a guide tube (inner coil tube) in the coil.

The problem with the well-known drop-on-demand printheads is the distance between the nozzles, as described below with reference to FIGS. 1, 2, 3A and 3B. For example, the well-known drop-on-demand printheads usually have a nozzle plate 1 with numerous nozzles 2, 3, 4, whereby droplets 5, 6, 7 are emitted through the nozzles 2-4 to a component 8. The nozzles 5-7 are arranged in a linear nozzle row in the nozzle plate 1. In addition, the well-known drop-on-demand printheads have actuators 9-11 for opening and closing the nozzles 2-4, which can be designed as electromagnetic actuators, for example, and each move one actuator needle 12-14. In the position of the actuator needles 12-14 shown in FIG. 3A, the actuator needles 12-14 close the nozzles 2-4 so that no coating agent is released through the nozzles 2-4. The nozzles 2-4 are arranged at a certain nozzle distance d along the nozzle row, while the actuators 9-11 have a certain width b along the nozzle row. This means that the nozzle distance d between the adjacent nozzles 2-4 cannot become smaller than the width b of the actuators 9-11, as otherwise the available installation space along the nozzle row would not be sufficient for the actuators 9-11.

In the diagram shown in FIG. 1, the droplets 5-7 are therefore so far apart on the component 8 that the droplets 5-7 do not lead to a continuous coating film on component 8, which is unacceptable.

During operation, the well-known drop-on-demand printheads are therefore rotated around an axis of rotation 15 perpendicular to the surface of the component 8 and perpendicular to the paint path which is perpendicular to the drawing plane. As a result, the nozzle distance d in the drawing plane, i.e. at right angles to the paint path, is reduced. This rotation of the drop-on-demand printhead allows the droplets 5-7 on the surface of component 8 to be so close together that after application they form a continuous coating film, as shown in FIG. 2. The rotation of the drop-on-demand nozzle head thus solves the problem that the minimum nozzle distance d is limited downwards by the width b of the actuators 9-11. However, it would be desirable to be able to do without such a rotation. In particular, it would be desirable to reduce the nozzle distance in a printhead.

With regard to the general technical background of the disclosure, reference should also be made to DE 33 02 617 A1, US 2013/0127955 A1, EP 0 426 473 A2, US 2005/0046673 A1, EP 1 862 311 A1, US 2015/0360472 A1 and WO 2010/046064 A1.

DETAILED DESCRIPTION

Figure 1:
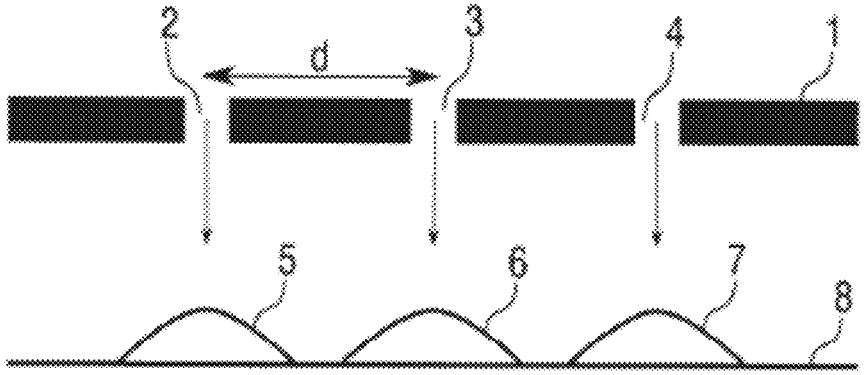
Fig. 1 Prior art
FIG. 1 a schematic representation of a conventional printhead with a large nozzle distance so that the droplets do not converge on the component.
Figure 2:
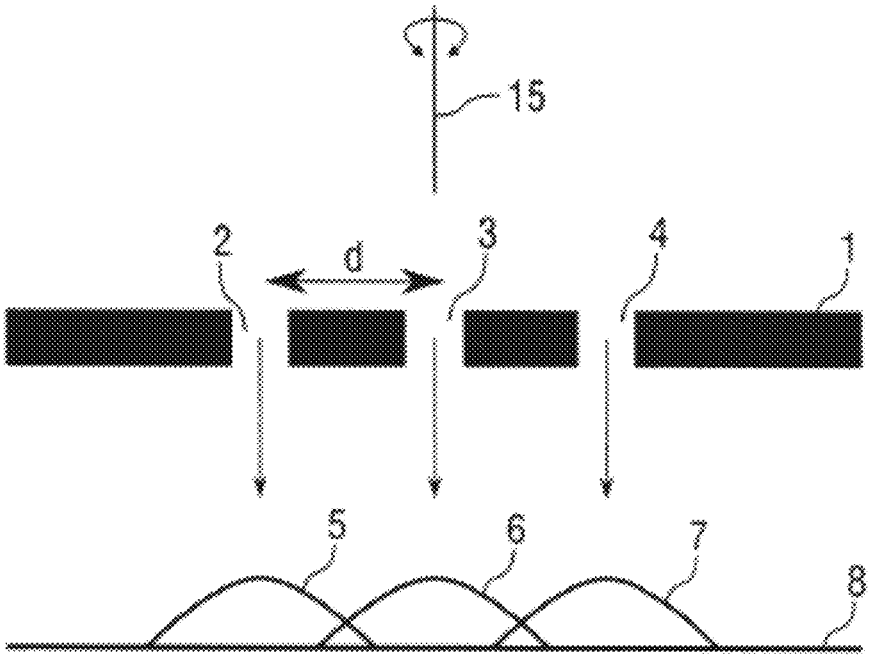
Fig. 2 Prior art
FIG. 2 is a variation of FIG. 1 where the printhead is rotated to reduce the nozzle distance perpendicular to the paint path, FIG. 3A a schematic representation of the conventional printhead according to FIGS. 1 and 2, FIG. 3B a schematic cross-sectional view of the printhead from FIG. 3A, FIG. 4 a schematic representation of a printhead according to the disclosure with a vertically offset arrangement of the individual actuators, FIG. 5 a schematic representation of a printhead according to the disclosure with a vertically offset arrangement of the different actuators to increase the linear packing density, FIG. 6 a schematic representation of a printhead according to the disclosure with a vertically and horizontally offset arrangement of the actuators to increase the linear packing density, FIG. 7 a schematic representation of a printhead according to the disclosure with a vertically offset arrangement of the actuators and uniformly long valve needles, FIG. 8 a schematic diagram illustrating the transmission of force from the actuators to the valve needles, FIG. 9 a schematic representation of a valve needle, FIG. 10 a schematic representation of a printhead according to the disclosure, with each actuator acting on several valve needles, FIG. 11 a schematic representation of a printhead according to the disclosure, whereby each of the actuators acts on a sealing element, which in each case releases or closes several nozzles, FIG. 12 a sectional view through an actuator according to the disclosure, FIG. 13 a modification of FIG. 12, FIG. 14 a schematic representation to illustrate the laterally offset arrangement of the actuators to increase the linear packing density of the actuators, FIG. 15 a schematic representation of a design in which two actuators act on a valve needle via a lifting bar, FIG. 16 a modification of FIG. 15, FIG. 17 a schematic diagram, where an actuator acts on a valve needle via a one-sided rocker arm, FIG. 18A a modification of FIG. 6 with two actuator rows in one view, FIG. 18B a side view of FIG. 18A, FIG. 19A a modification of FIG. 18A, FIG. 19B a side view of FIG. 19A, FIG. 20 a schematic representation of the vertical and horizontal pulling-apart of the actuators.

The disclosure is based on the task of creating a correspondingly improved applicator (e.g. printhead).

The applicator (e.g. printhead) according to the disclosure is generally suitable for the application of a coating agent. The disclosure is therefore not limited to a specific coating agent with regard to the type of coating agent to be applied. Preferably, however, the printhead is designed for the application of a paint. Alternatively, within the scope of the disclosure there is also the possibility that the coating agent is an adhesive or a sealing material, for example for sealing seams in vehicle body components. The applicator according to the disclosure can therefore also be designed as an adhesive applicator or as a sealing material applicator.

It should also be mentioned that the applicator (e.g. printhead) according to the disclosure is generally suitable for applying the coating agent (e.g. paint) to a specific component. With regard to the type of component to be coated, the disclosure is also not limited. Preferably, however, the printhead according to the disclosure is designed to apply a coating agent (e.g. paint) to a motor vehicle body component or an add-on part of a motor vehicle body component.

The applicator (e.g. printhead) according to the disclosure initially has a nozzle row with several nozzles in order to apply the coating agent in the form of a jet, whereby the nozzles are arranged along the nozzle row in a common nozzle plane.

It should be mentioned that the applicator according to the disclosure (e.g. printhead) does not emit a spray mist of the coating agent from the nozzles, but spatially limited jets with only a smaller jet expansion. The printhead according to the disclosure thus differs from atomizers (e.g. rotary atomizers, air atomizers, etc.), which do not emit a spatially limited jet of the coating agent, but a spray of the coating agent.

It should also be mentioned here that the coating agent jets emitted by the applicator can each consist of numerous droplets which are separated from each other in the longitudinal direction of the jet. Alternatively, however, it is also possible that the individual coating agent jets are connected in the longitudinal direction of the jet and can therefore also be referred to as continuous coating agent jets.

It should also be mentioned that the applicator (e.g. printhead) according to the disclosure can have a single nozzle row in which the nozzles are preferably arranged equidistantly. However, within the scope of the disclosure there is also the possibility that the printhead has several nozzle rows, which are preferably arranged parallel to each other.

In addition, the applicator (e.g. printhead) according to the disclosure has several actuators to either release or close the nozzles. The actuators can be electromagnetic actuators, piezoelectric actuators or pneumatic actuators, to name just a few examples. The disclosure is therefore not limited to a specific actuator type with regard to the physical principle of action of the actuators.

The disclosure now provides that the actuators are offset at different distances at right angles to the nozzle row in order to enable a high linear packing density of the actuators along the nozzle row and a small nozzle distance of the adjacent nozzles along the nozzle row.

In a variant of the disclosure, the different actuators are arranged one above the other at different vertical distances to the nozzle plane in order to enable the high linear packing density of the actuators along the nozzle row and the small nozzle distance of the adjacent nozzles along the nozzle row. The arrangement of the different actuators in different planes above each other parallel to the nozzle plane allows the actuators in the different planes to overlap with their outer contours along the nozzle row. This is made possible by the fact that the actuators are not arranged in the same plane, but in different planes at different distances from the nozzle plane. This makes it possible to reduce the nozzle distance of the immediately adjacent nozzles below the width of the actuators along the nozzle row.

In another variant of the disclosure, on the other hand, the actuators are arranged in the nozzle plane at different horizontal distances to the nozzle row in order to enable the high linear packing density of the actuators along the nozzle row and the small nozzle distance of the adjacent nozzles along the nozzle row. In this case, the actuators are positioned parallel to the nozzle plane at the side of the nozzle row at different distances. This also makes it possible to reduce the nozzle distance between the adjacent nozzles below the width of the actuators along the nozzle row. Also in this variant, the packing density of the actuators along the nozzle row can be increased and the nozzle distance reduced accordingly.

The first variant thus provides for a vertically offset arrangement of the actuators, while the second variant provides for a horizontally offset arrangement of the actuators. The terms "horizontal" and "vertical" refer to the nozzle plane, i.e. with a horizontally offset arrangement of the actuators, the actuators are offset parallel to the nozzle plane, while a vertical offset means that the actuators are offset at right angles to the nozzle plane.

The two variants of the disclosure described above can be used alone or in combination with each other.

The disclosure allows the actuators to have an external dimension along the nozzle row that is greater than the nozzle distance along the nozzle row. The disclosure therefore allows a reduction of the nozzle distance without miniaturizing the actuators.

In one embodiment of the disclosure, the actuators are each connected with a sliding valve needle. The nozzles of the printhead are released or closed by the valve needle. The actuators can thus be arranged in a linear actuator row parallel to the nozzle row. The force transmission from the actuators to the valve needles can be effected by a mechanical connecting element, such as an arm (hammer), a lifting beam or a rocker arm, whereby the rocker arm can be swivelled and can act on one or two sides.

In a variant of the disclosure, the actuator needles themselves are also the valve needles, so that a connecting element between the actuator needles and the valve needles can be dispensed with.

In another variant of the disclosure, however, separate valve needles are provided in addition to the actuator needles. The actuator needles act on the valve needles via connecting elements (e.g. arm, rocker arm, hammer).

In a variant of the disclosure, several (e.g. two) actuators each act jointly on a valve needle, in particular via a common lifting beam. The two actuators can act externally on the lifting bar, while the valve needle is driven by the lifting bar in the middle of the lifting bar. The two actuators can either pull the lifting bar into the closed position and push it into the open position or vice versa push it into the closed position and pull it into the open position.

It has already been mentioned above that in a variant of the disclosure it is provided that the actuators are arranged offset at different vertical distances from the nozzle plane. The distance between the different actuators and the nozzle plane is therefore different. This enables the valve needles to be of different lengths. The actuators that are further away from the nozzle plane then have a longer valve needle than the actuators that are closer to the nozzle plane.

However, the different length of the valve needles means that the valve needles have different inertia behaviour, so that the dynamic response behaviour of the actuators is different depending on the length of the valve needles. It is possible that all actuators can have valve needles of essentially the same length and/or weight regardless of their distance from the nozzle plane, so that the dynamic response of the actuators is uniform regardless of their distance from the nozzle plane. The different actuators then engage with the uniformly long valve needles at different distances from the nozzle plane.

The valve needles can be one-piece or multi-piece (e.g. two-piece).

In one embodiment of the disclosure, the valve needles each have a valve needle tip that tapers conically towards its free end.

Furthermore, within the scope of the disclosure it is possible that the individual valve needle tips each have a separate sealing element.

For example, the separate sealing element can be glued onto the valve needle tip. Alternatively, it is also possible for the valve needle tip to have a socket in which the sealing element is inserted. Alternatively, there is also the possibility that the valve needle tip can be enclosed by the separate sealing element over part of its length.

It should also be mentioned that the valve needle and the sealing element can be made of different materials, in particular metal for the valve needle and plastic for the sealing element.

The sealing element can be attached to the tip of the valve needle by injection moulding, dipping, welding or vulcanising, to name just a few examples.

One embodiment of the disclosure provides that at least one of the actuator needles closes several nozzles. One possibility for this is that one actuator needle acts mechanically on several sliding valve needles, each of which closes one nozzle. Another possibility for realizing this technical design is that at least one of the actuator needles is connected to a sealing element that closes or opens several of the nozzles together.

Furthermore, an embodiment of the disclosure provides that a valve seat with a separate sealing element is associated with each individual nozzle, whereby the valve seat is selectively closed or released by a valve needle tip. The sealing element in the valve seat and the valve needle tip can be made of metal, plastic, ceramic or semiconductor, for example, so that the nozzle needle tip on the one hand and the sealing element in the valve seat on the other hand can be a material combination of metal, ceramic, semiconductor and/or plastic.

In one embodiment of the disclosure, the valve needle or actuator needle is subjected to a restoring force by a return spring, whereby the restoring force can act either in the open position or in the closed position.

In another embodiment, the actuators act double, i.e. in both directions. In this case, no springs are required for resetting.

In addition, the individual actuators can each have a position adjustment to adjust the position of the actuator within the printhead. For example, such a position adjustment can have set screws, set collars, or a space for shims.

It should also be mentioned that the individual actuators preferably have an actuator housing, a hammer, an armature (plunger), a cover and/or a core made of a soft magnetic material, in particular with a saturation magnetization of 0.01 T, 2.4 T or 0.6-2.4 T. The actuator housing can, for example, be cylindrical and have a separate cover. The cover can be connected to the actuator housing, for example by gluing or screwing.

The actuators, the actuator needles, and/or the nozzle needles and the nozzle plate can be mounted in a housing. In another embodiment, the housing is at least two-piece. In particular, the housing part in which the actuators are positioned can be in two parts, so that, for example, half of the actuators and actuator rods are assigned to a first housing half and the second half of the actuators and actuator rods to a second housing half. The actuators can be arranged in several planes on top of each other and several actuators can be arranged next to each other in each actuator plane.

In another embodiment, the valve needles of a vertical actuator row are positioned next to each other at a distance of the nozzle openings from each other. Adjacent to this is a gap in which the valve needles of the vertical actuator row of the other half of the housing are positioned.

The minimum possible nozzle distance results from the horizontal and vertical arrangement of the actuators and the associated actuator needles or valve needles according to the following formula:

$$a = \frac{n}{erh}$$

where a=distance between nozzles [mm]

n=number of nozzles e=number of planes r=number of actuators in a row h=number of housing parts Example:

n=48, e=6, r=4 and h=2 results in a minimum possible nozzle distance of 1 mm.

The number of planes e can be ≥2, ≥6 or even ≥12.

The number of actuators in a row r can be ≥1, ≥4, ≥10 or even ≥100.

Number of housing parts h can be ≥1, ≥2 or even ≥4

In this context, the maximum actuator diameter d (including its confining walls) results from the formula $$d \leq he \text{ or}$$

$$d \leq \frac{n}{ra}$$

Example: e=6 and h=2 results in a maximum possible actuator diameter of 12 mm.

In the case of the printhead in accordance with the disclosure, the nozzles immediately adjacent to each other can have a very small nozzle distance with respect to their nozzle centres, which can be a maximum of 3 mm, 2 mm, 1.5 mm, 1.3 mm, 1 mm or even a maximum of 0.8 mm, for example.

The directly vertically adjacent actuators can have an actuator distance of at most 3 mm, 2 mm, 1.5 mm, 1.3 mm, 1 mm or even 0.8 mm with respect to the longitudinal axis of their valve needles.

It should also be mentioned that the nozzles can be arranged in a linear nozzle row, in particular equidistant.

It should also be mentioned that the different valve needles are preferably parallel to each other, especially at right angles to the nozzle plane.

In total, the printhead can contain a large number of nozzles, for example more than 20, 30, 40, 50, 100, 150 or even more than 200 nozzles.

Furthermore, the printhead may have guide elements (e.g. guide rails) for the individual actuator needles or valve needles, which stabilize the needles on the way to the nozzle plate or define the way to the nozzle plate, thereby preventing buckling of the actuator needles or valve needles. The guide elements thus guide the actuator needles or valve needles radially.

With regard to the individual actuator needles or valve needles, it should be mentioned that they can have a certain ratio of diameter to length, which can be smaller than 0.2, 0.15, 0.007 or 0.005 within the scope of the disclosure.

With regard to the length of the individual actuator needles or valve needles, it should be mentioned that this can preferably be in the range of 20 mm-500 mm, 75 mm-300 mm or 75 mm-150 mm.

The axial maximum stroke of the individual actuator needles or valve needles, on the other hand, is preferably in the range of 10 μm-500 μm, 30 μm-200 μm or 30 μm-100 μm.

It should also be mentioned that the valve needles can be provided with a corrosion protection coating for corrosion protection. This anti-corrosion coating can consist of diamondlike carbon or carbon nitrides, for example, and the anti-corrosion coating can be applied by chemical vapour deposition (CVD) or physical vapour deposition (PVD).

It has already been briefly mentioned above that the actuators can operate electromagnetically, piezoelectrically or pneumatically (single acting or double acting). The disclosure is therefore not limited to a specific operating principle with regard to the type of actuator.

When implemented as an electromagnetic actuator, the actuators preferably have a coil with a number of turns of 10-2000, 200-1000 or 250-900.

Furthermore, the coils are preferably wound with a coil wire which has a wire diameter of 0.05 mm-2 mm, 0.1 mm-1 mm or 0.1-0.5 mm.

The electrical contacting of the electrically controlled actuators in the printhead according to the disclosure can be done, for example, by integrated contact pins or by leading out the coil wire.

The actuators can be blown or flushed with a fluid, especially a gas such as compressed air, to dissipate the heat generated during operation. The fluid can be discharged either via the inside or outside of the housing.

The external dimensions (i.e. maximum length, width or height) of the printhead according to the disclosure are preferably 550 mm, 450 mm or 350 mm at most.

It should also be noted that the printhead may have connections, for example, for the supply of coating agents, for the supply of flushing agents, for the supply of compressed air and/or for the return line to a return. This also allows the printhead to have an integrated material circulation.

It should also be mentioned that the disclosure does not only claim protection for the printhead described above as a single component. Rather, the disclosure also claims protection for a coating robot (e.g. painting robot) with such a printhead.

The printhead can, for example, be attached to the coating robot in an exchangeable manner by means of a quick-change device. Such a quick-change device can, for example, have a clamping spigot, as it is known from the state of the art and therefore does not need to be described in detail.

Figure 3A:
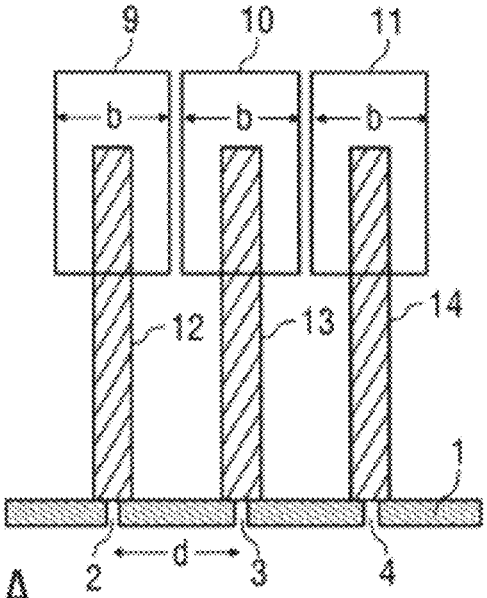
Fig. 3A Prior art
Figure 4:
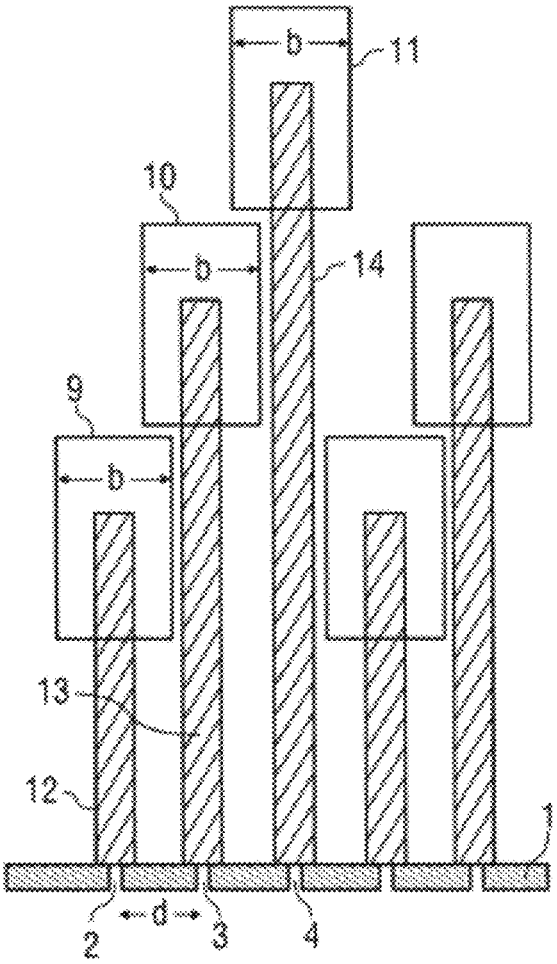
Figure 3B:
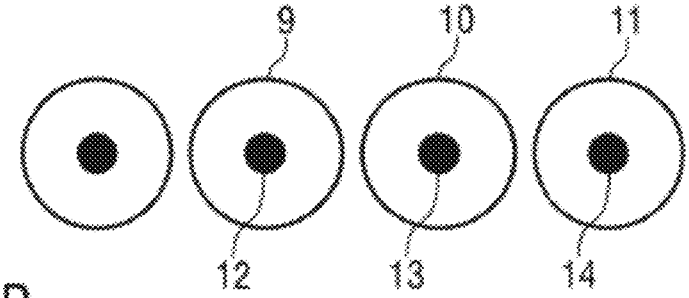
Fig. 3B Prior art

FIG. 4 shows a schematic representation of a printhead according to the disclosure which partly corresponds to the known printhead as shown in FIGS. 3A and 3B so that reference is made to the above description to avoid repetition, using the same reference signs for corresponding details.

A feature of this embodiment is that the actuators 9-11 are not arranged in the same plane parallel to the plane of the nozzle plate 1. Rather, the actuators 9-11 are arranged at different distances from the plane of the nozzle plate 1 so that their outer contours do not overlap in the vertical direction (i.e. perpendicular to the plane of the nozzle plate 1). This makes it possible to reduce the distance between the actuators 9-11 along the nozzle row without the need for additional miniaturization of the actuators 9-11. The nozzle distance d can therefore be smaller than the width b of the individual actuators 9-11.

In the embodiment shown in FIG. 4, the actuators 9-11 are arranged in three different actuator planes parallel to the plane of the nozzle plate 1.

Figure 5:
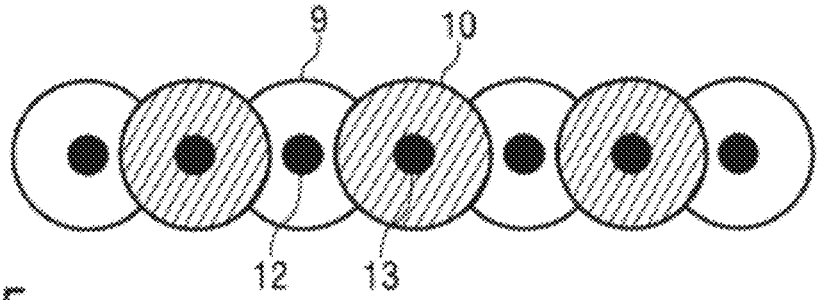

In the alternative embodiment shown in FIG. 5, the different actuators 9 and 10 are arranged in two different actuator planes parallel to the plane of the nozzle plate 1.

Figure 6:
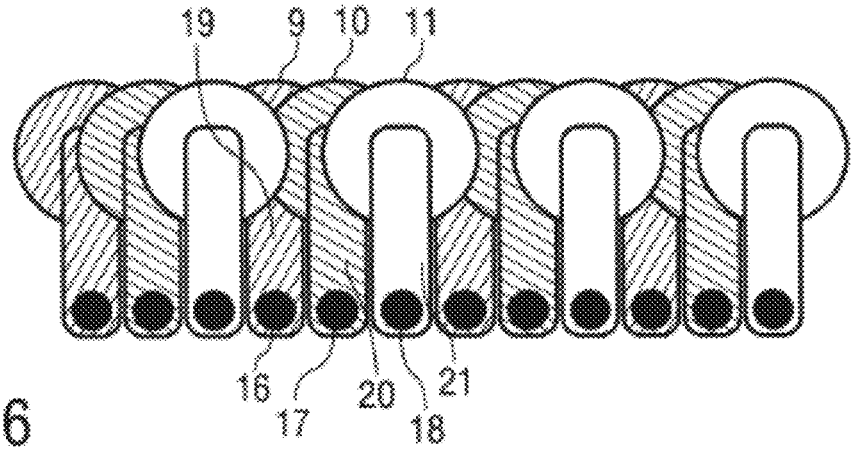

FIG. 6 shows a schematic representation of another possible embodiment of the disclosure, which again partly corresponds to the embodiments described above, so that the above description is referred to avoid repetitions.

A feature here is that the actuators 9-11 are offset both vertically and horizontally. The valve function is fulfilled by the valve needles 16-18, which are driven by the actuators 9-11 via mechanical connecting elements 19-21 (e.g. arm, lifting bar, rocker arm).

Figure 7:
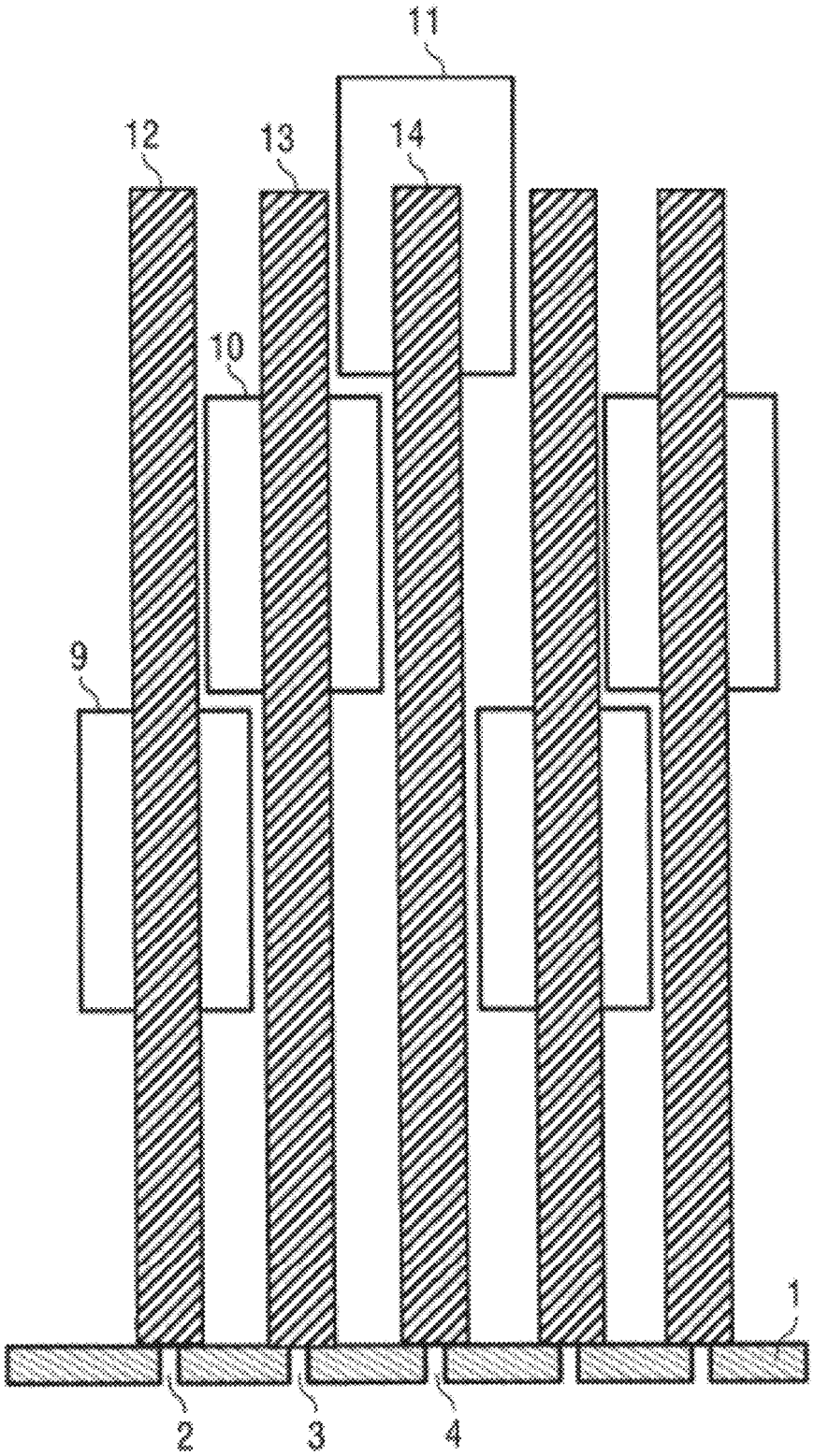

FIG. 7 shows a variation of the embodiment given in FIG. 4, so that to avoid repetition, reference is made to the above description, using the same reference signs for the corresponding details.

A feature of this embodiment is that the valve needles 12-14 here have a uniform length and thus also a uniform mass. This is advantageous because the dynamic response behaviour of the actuators 9-10 is not changed by different masses of inertia.

Figure 8:
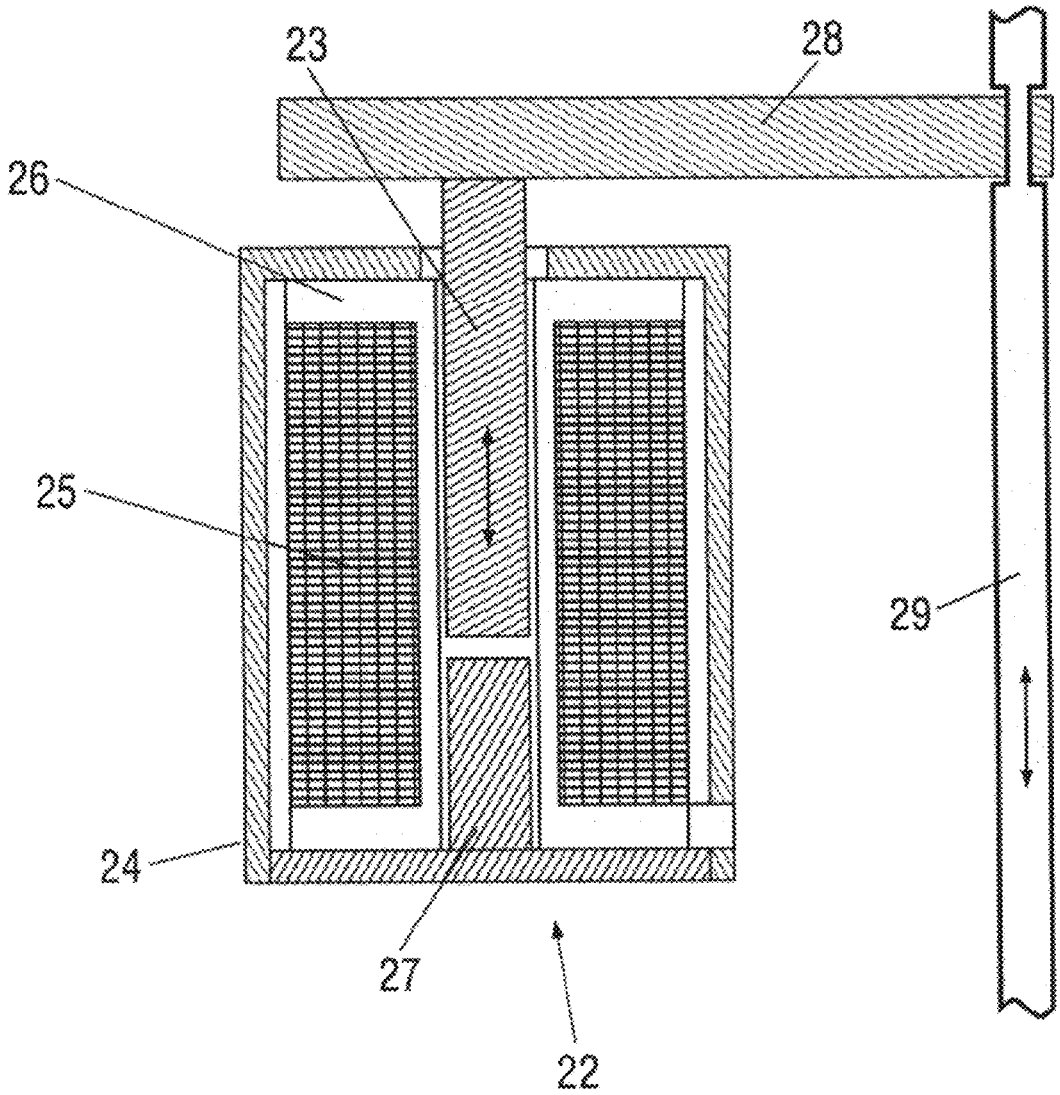

FIG. 8 shows a cross-sectional view of an actuator 22 according to the disclosure with an armature 23 movable in the direction of the double arrow, a housing 24, a coil 25, a coil former 26 and a magnetic core 27.

The sliding armature 23 transmits its movement via a hammer 28 to a valve needle 29.

Figure 9:
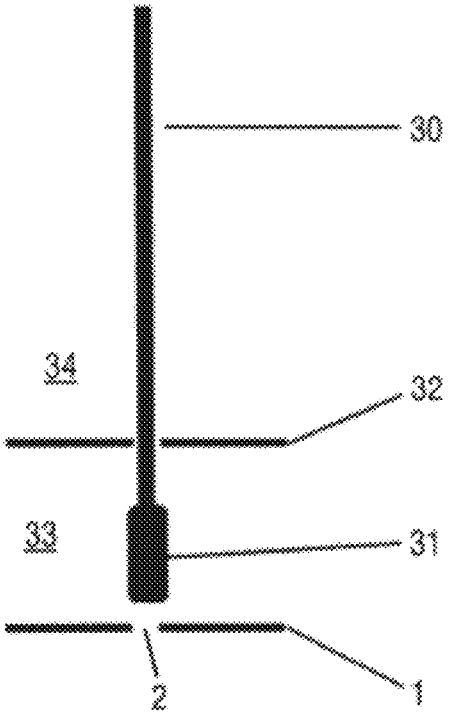

FIG. 9 shows a schematic representation of a valve needle 30 with a valve needle tip 31 with an additional seal.

In addition, a sealing membrane 32 is shown, which separates a coating agent-filled nozzle chamber 33 from an actuator chamber 34. The sealing membrane 32 prevents the coating agent from passing from the nozzle chamber 33 into the actuator chamber 34, where it contaminates the actuators.

Figure 10:
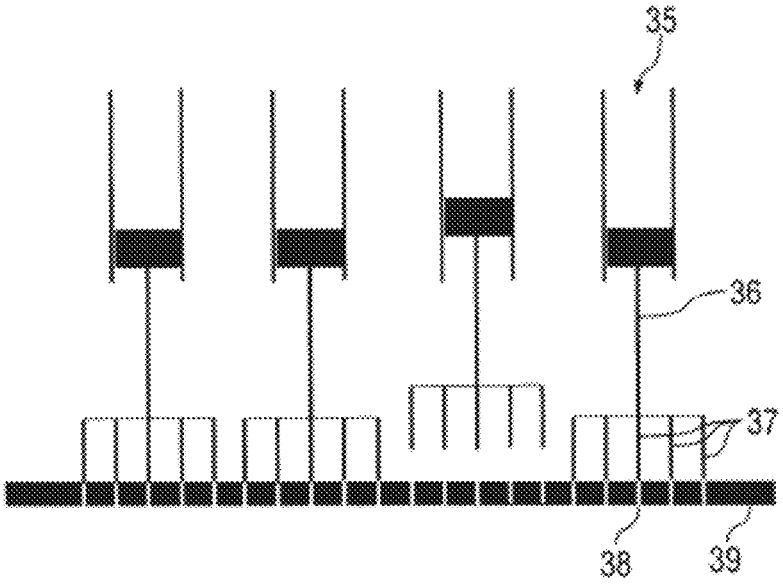

FIG. 10 shows an embodiment of the disclosure, whereby an actuator 35 with its actuator needle 36 acts on five valve needles 37 each and thus optionally closes or releases several nozzles 38 in a nozzle plate 39.

Figure 11:
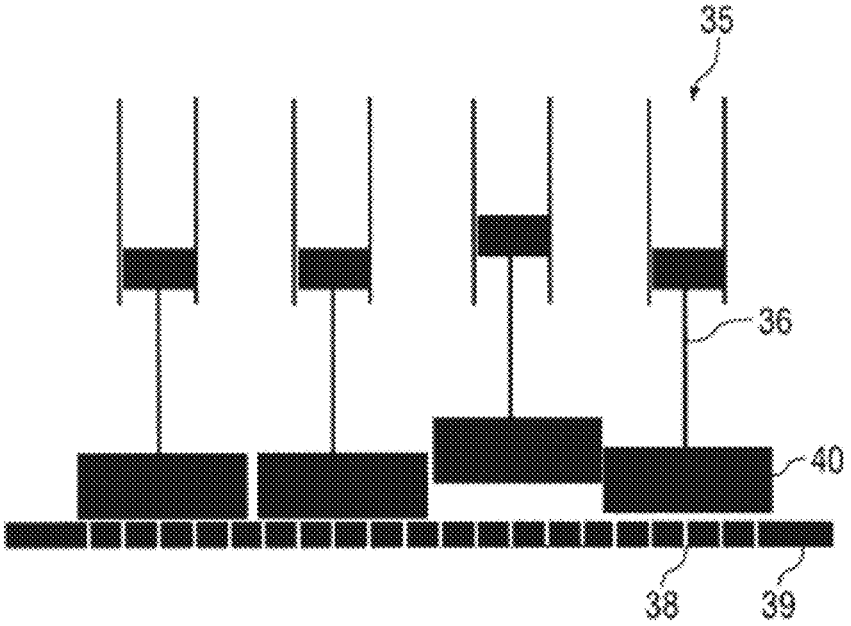

FIG. 11 shows a modification of the design according to FIG. 10. Here the actuator needle 36 acts on a sealing element 40, which then selectively releases or closes several of the nozzles 38.

Figure 12:
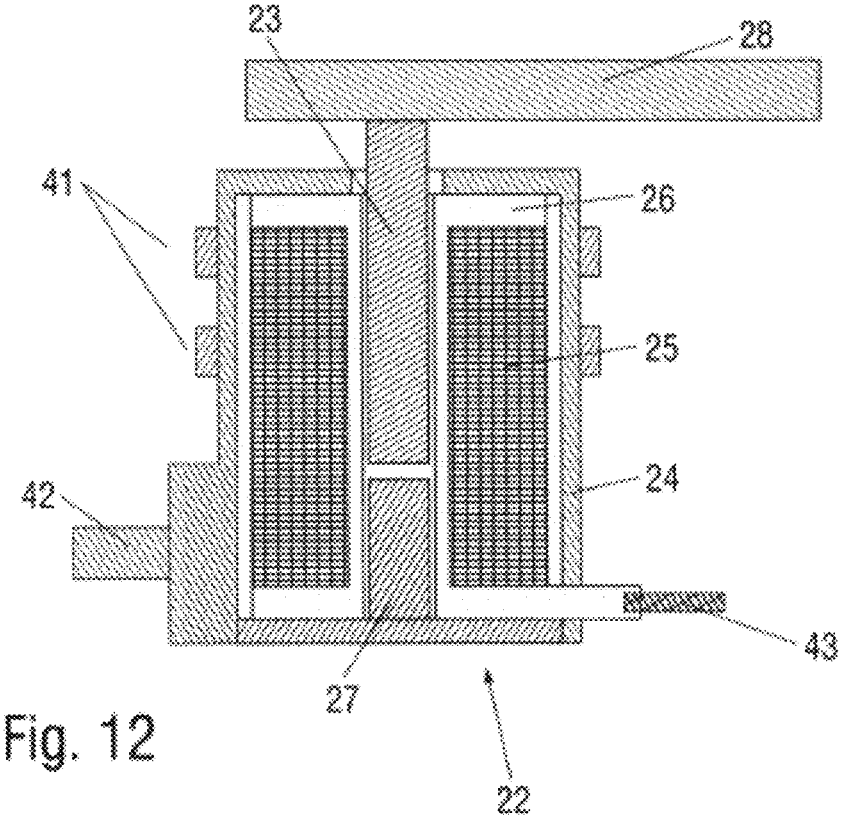

FIG. 12 shows a modification of FIG. 8, so that the above description is referred to avoid repetitions, whereby the same reference signs are used for corresponding details.

A feature of this representation is that an adjustment device 41 is also shown to adjust the position of the actuator 22 in the printhead.

In addition, integrated fitting surfaces or fitting pins 42 are shown.

Finally, FIG. 12 also shows an integrated contact 43 for the electrical contact of the coil 25.

Figure 13:
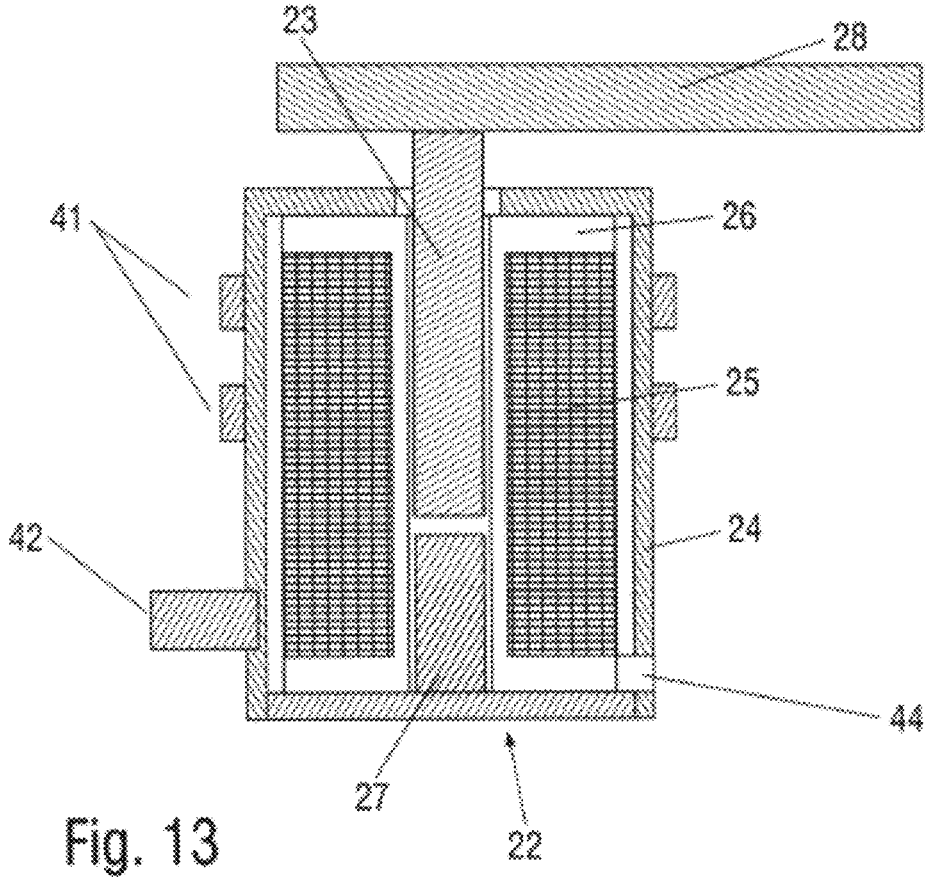

FIG. 13 shows a variation of FIG. 12, so that to avoid repetitions, the above description is referred to and the corresponding details are given using the same reference signs.

A feature of this embodiment is that instead of the integrated electrical contacting 43, a hole 44 is provided for the electrical contacting. The cable ends of the coil can be led out of this hole.

Figure 14:
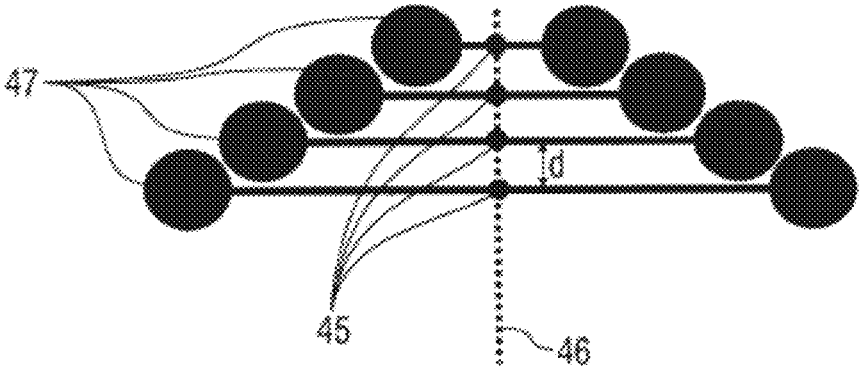

FIG. 14 shows a schematic illustration of a second disclosure variant. Here, nozzles 45 are arranged equidistantly along the nozzle row 46 at a certain nozzle distance d. The nozzle distance d is determined by the nozzle distance d and the nozzle distance d.

The nozzles 45 are released or closed by valve needles which are not shown, whereby the individual valve needles are mechanically driven by actuators 47. The actuators 47 are offset at different distances to the side of the nozzle row 46 with respect to the nozzle row 46. This enables the linear packing density of the actuators 47 to be increased along the nozzle row 46, so that the nozzle distance d can also be reduced accordingly.

Figure 15:
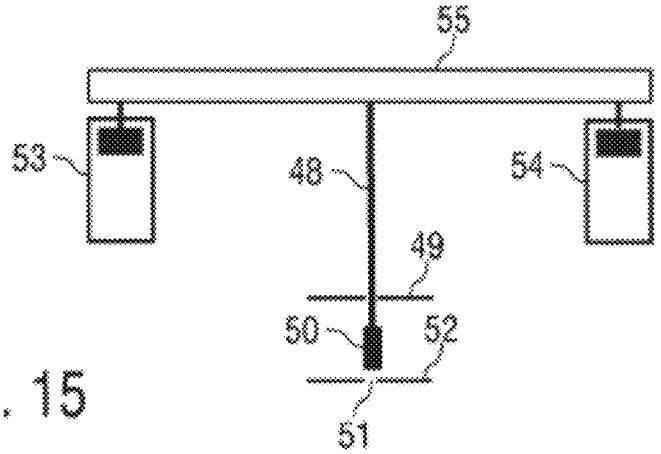

FIG. 15 shows a schematic representation of the mechanical control of a nozzle needle 48, which is guided through a sealing membrane 49 and with its valve needle tip 50 optionally releases or closes a nozzle 51 in a nozzle plate 52.

The drive of the nozzle needle 48 is realized by two actuators 53 and 54 jointly acting on the nozzle needle 48 via a common lift bar 55.

The two actuators 53, 54 act on the outside of the lifting bar 55, while the lifting bar 55 acts on the nozzle needle 48 at its centre.

It should also be mentioned in this context that the two actuators 53, 54 pull the nozzle needle 48 into a closed position and push it into the opposite open position.

Figure 16:
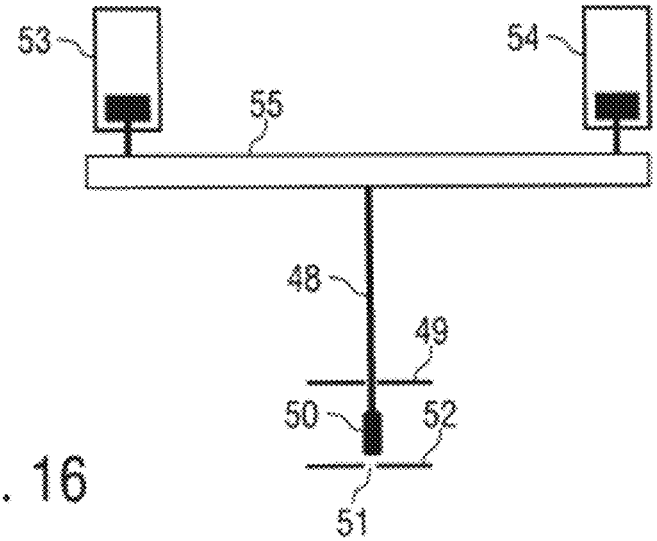

FIG. 16 shows a variation of FIG. 15 so that to avoid repetition, reference is made to the above description, using the same reference signs for corresponding details.

A feature of this embodiment is that the two actuators 53, 54 push the nozzle needle 48 into the closed position and pull it into the open position.

Figure 17:
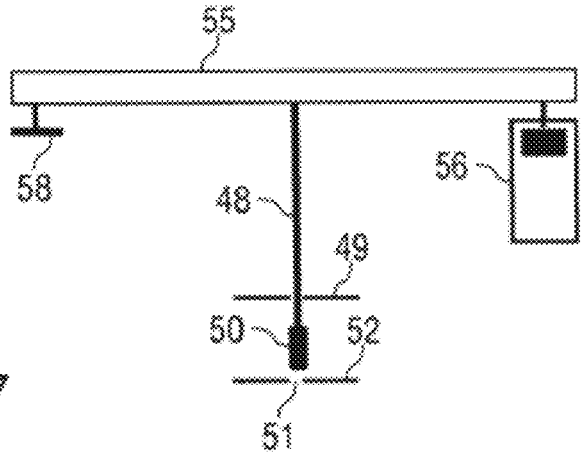

FIG. 17 shows a variation of FIGS. 15 and 16, respectively, so that the above description is referred to again to avoid repetitions, using the same reference signs for the same details.

A feature of this embodiment is that the nozzle needle 48 is driven by a single actuator 56 via a one-sided rocker arm 57, whereby the rocker arm 57 is pivoted in a support 58.

Figure 18A:
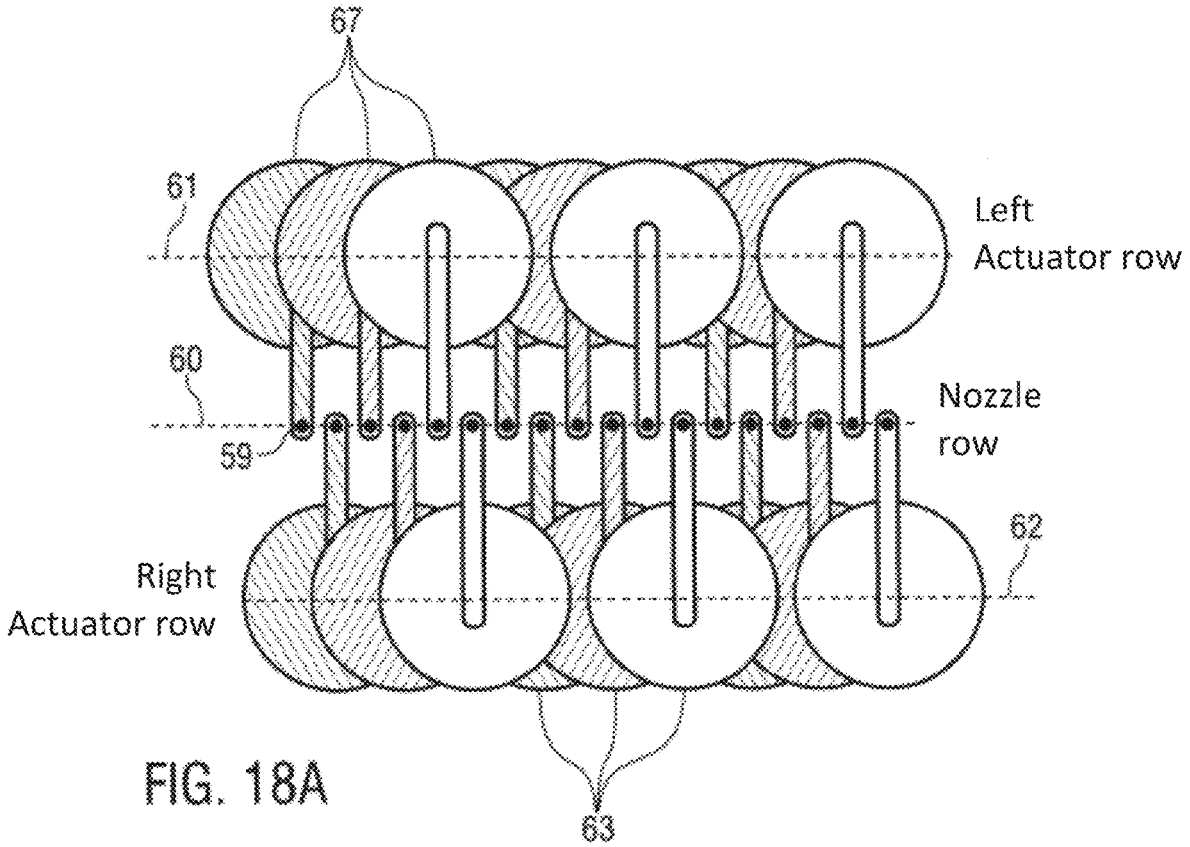
Figure 18B:
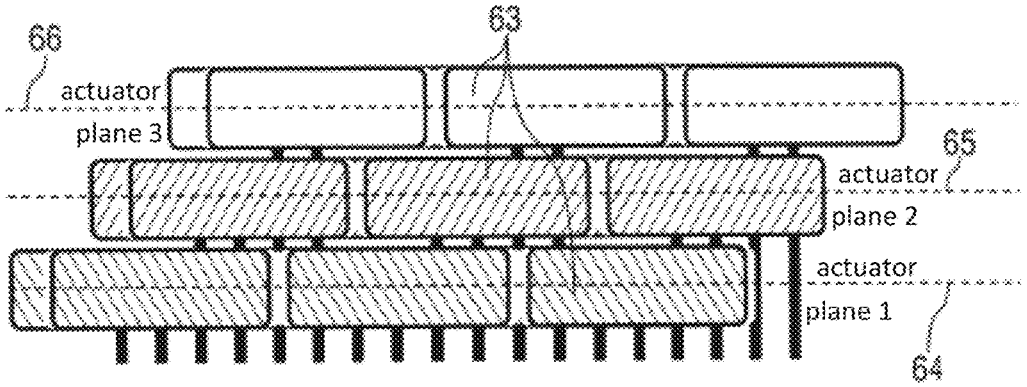

FIGS. 18A and 18B show a variation of the embodiment given in FIG. 6, so that reference is also made to the above description to avoid repetition.

Numerous nozzles 59 in a nozzle row 60 are arranged equidistantly one behind the other.

On both sides of the nozzle row 60 an actuator row 61, 62 is arranged parallel to the nozzle row 60.

The actuator row 62 comprises several actuators 63, which are arranged in three actuator planes 64, 65, 66 above each other, as shown in FIG. 18B.

The other actuator row 61 also comprises several actuators 67, which are also arranged one above the other in the three actuator planes 64-66.

The actuators are thus arranged both horizontally (i.e. across the nozzle row 60) and vertically (i.e. perpendicular to the nozzle plane) spatially pulled-apart. This enables a reduction of the nozzle distance between the adjacent nozzles 59 of the nozzle row 60.

Here the valve needles for the nozzles 59 of the nozzle row 60 are alternately connected with the actuators 67, 63 of both actuator rows 61, 62.

The nozzle needle 48 is controlled by two actuators 53, 54, which act on the nozzle needle 48 via a common lifting beam 55.

Figure 19A:
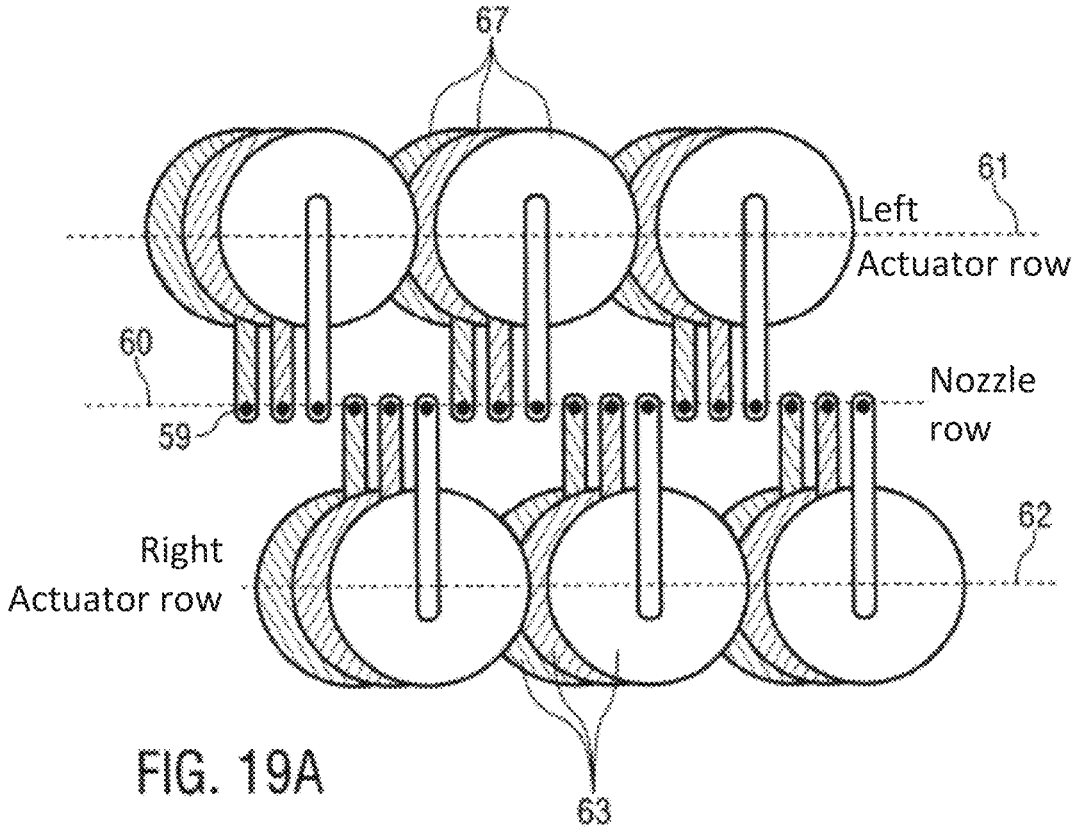
Figure 19B:
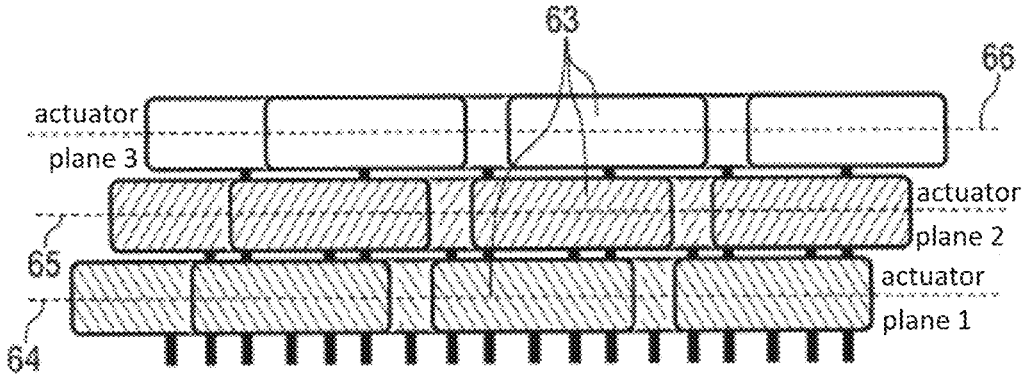

FIGS. 19A and 19B show a variation of the embodiment according to FIGS. 18A and 18B, so that the above description is referred to to avoid repetitions, using the same reference signs for corresponding details.

A feature of this embodiment is that the actuators 63, 67 are always connected in groups with the corresponding valve needles for the nozzles 59. Thus the valve needles for the first three nozzles 59 of the nozzle row 60 are controlled by the first three actuators 67 of the actuator row 61. The valve needles for the next three nozzles 59 of the nozzle row 60 are then controlled by the first three actuators 63 of the other actuator row 62.

Figure 20:
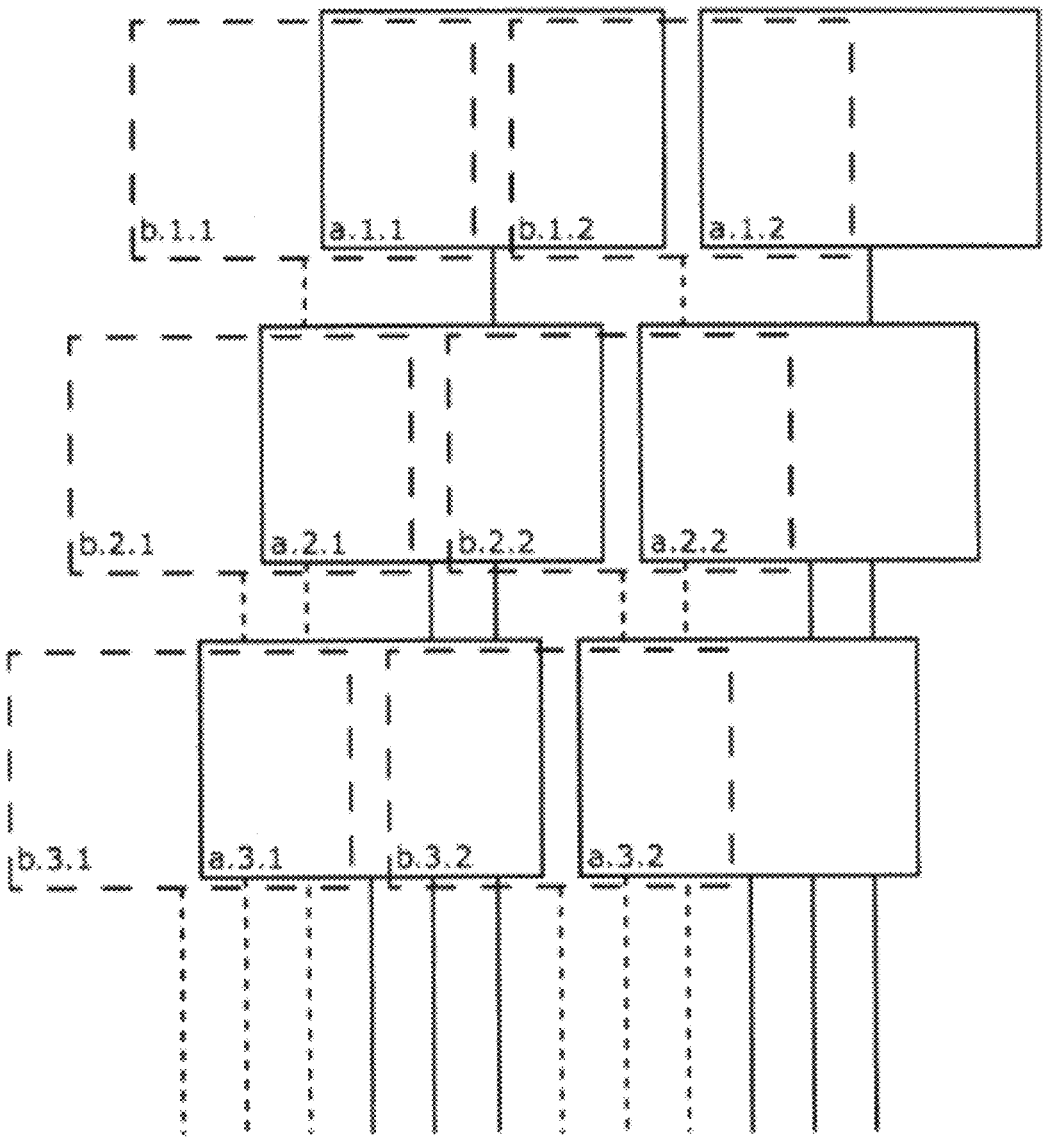

FIG. 20 shows a schematic illustration of the spatial pulling-apart of actuators both in the vertical direction (i.e. perpendicular to the nozzle plane) and in the horizontal direction (i.e. parallel to the nozzle plane).

Here two actuator rows are arranged parallel to each other and parallel to the nozzle row in three actuator planes shown as examples.

In the upper actuator plane, the right actuator row comprises two actuators a.1.1 and a.1.2 as examples, while the other actuator row comprises two actuators b.1.1 and b.1.2 as examples.

The same applies to the middle actuator plane, which also has two actuator rows with two actuators each a.2.1, a.2.2 and b.2.1 and b.2.2 respectively.

Finally, the lower actuator plane also contains two actuator rows each with two actuators a.3.1, a.3.2 and b.3.1, b.3.2 as examples.

It should be mentioned here that the number of actuators in the individual actuator rows is considerably larger in practice than shown and described above for illustration purposes.

Figure 21:
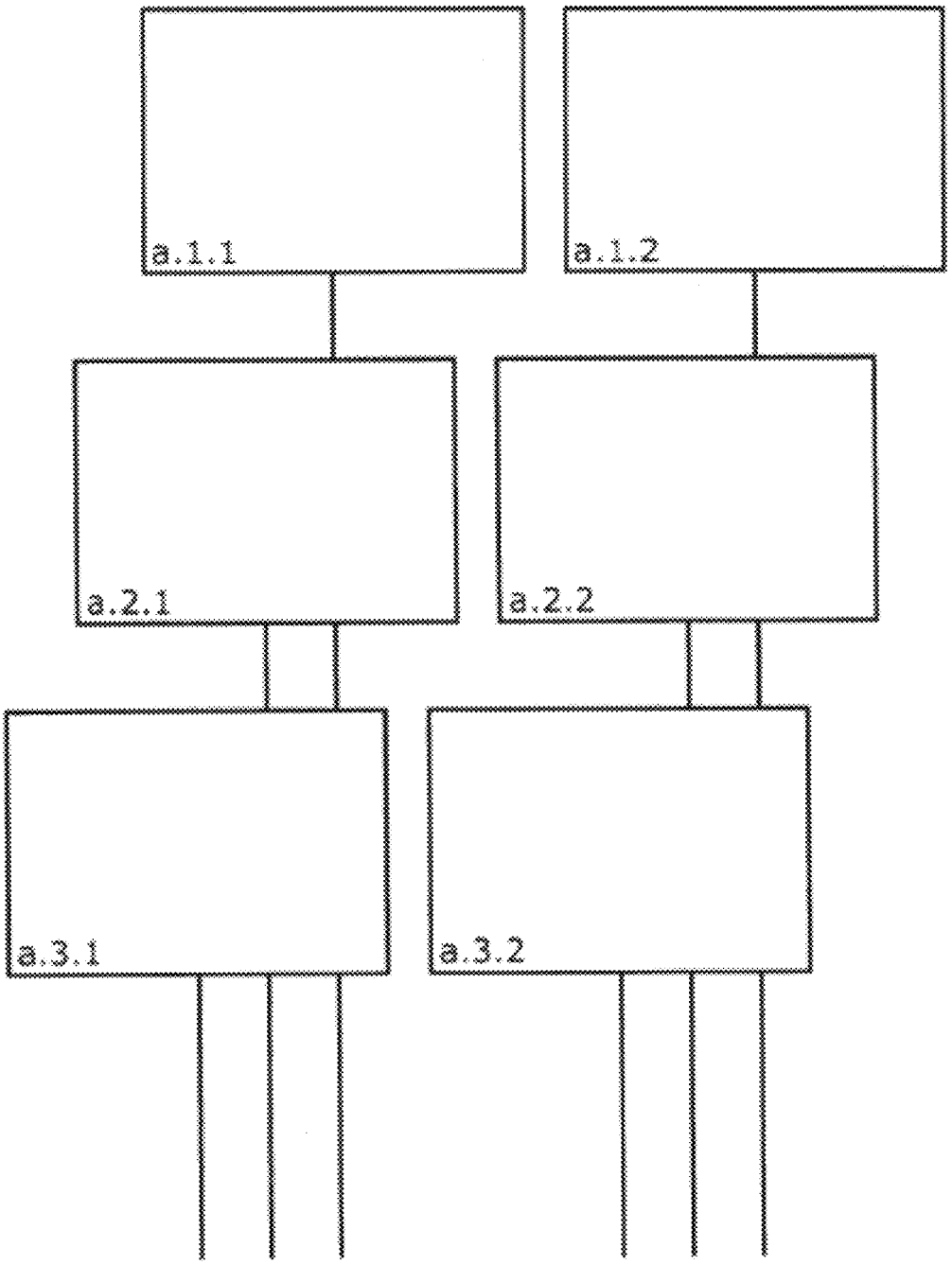
FIG. 21 is a modification of FIG. 20, FIG. 22A a schematic diagram for the cooling of the actuators, FIG. 22B a different view to FIG. 22A, FIGS. 23-25 different views of valve needle tips, FIG. 26 a schematic representation of valve needle tips formed on a membrane.

FIG. 21 shows a modification of FIG. 20 so that the above description is referred to to avoid repetition, using the same reference signs for corresponding details.

A feature of this embodiment is that the actuators a.1.1, a.1.2, a.2.1, a.2.2, a.2.2, a.3.1, a.3.2 are spatially pulled-apart only vertically, i.e. in three actuator planes one above the other. However, horizontal spatial pulling-apart (i.e. transverse to the nozzle row) is not provided.

Figure 22A:
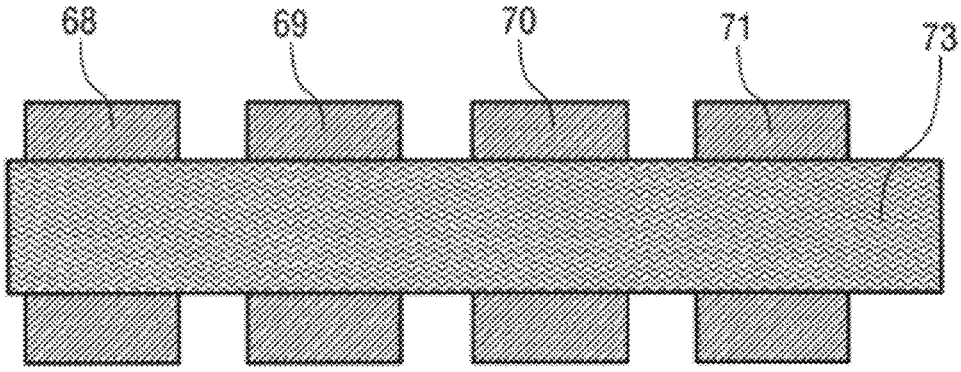
Figure 22B:
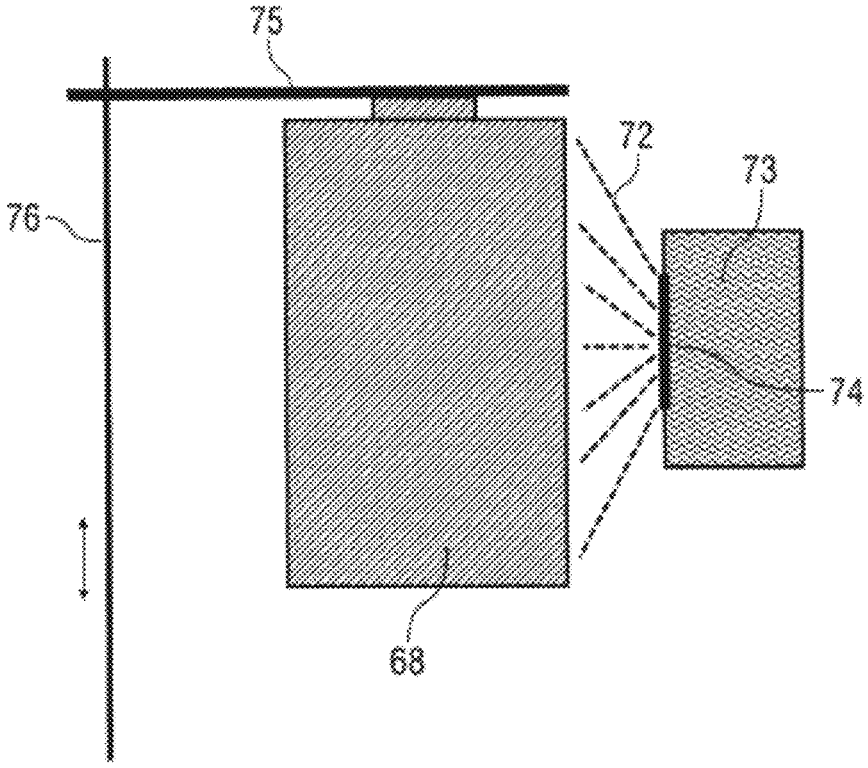

FIGS. 22A and 22B show a schematic illustration to explain the cooling of actuators 68-71 by compressed air 72, which flows out of a compressed air distributor 73 through a nozzle 74 and is led to the actuators 68-71 to cool the actuators 68-71.

The individual actuators 68-71 each act via a hammer 75 on a valve needle 76.

Figure 23:
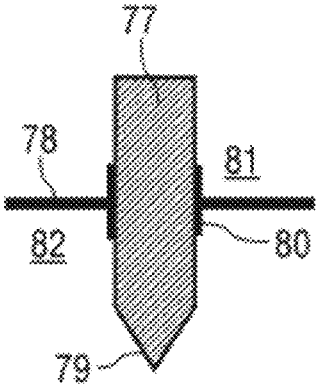
Figure 24:
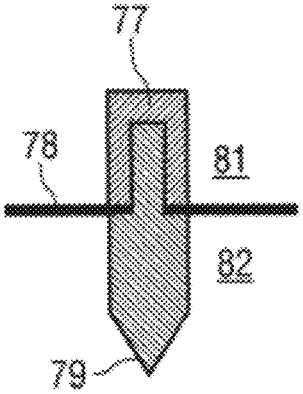
Figure 25:
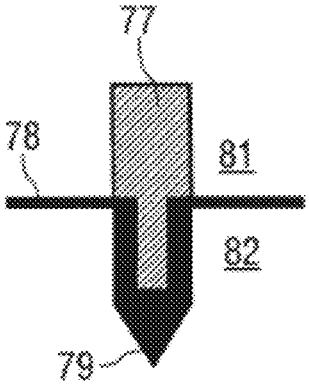

FIGS. 23-25 show various possible designs for the passage, connection or placement of valve needles 77 through a sealing membrane 78.

In FIG. 23, the valve needle 77 is continuous and thus, with its nozzle shut-off tip 79, also forms a sealing element for closing or releasing a corresponding valve seat.

In addition, it can be seen from the drawing that a sealing collar 80 is integrally formed on the sealing membrane 14, which protrudes from the sealing membrane 78 both towards an actuator chamber 81 and towards a nozzle chamber 82.

In the design shown in FIG. 24, the nozzle shut-off tip 79 is separated from the valve needle 77 and screwed to the valve needle 77. The sealing membrane 78 is pressed in between the valve needle 77 and the nozzle valve tip 79 so that the valve needle 77 is firmly connected to the sealing membrane 78. A displacement of the valve needle 77 thus leads to a corresponding deflection of the sealing membrane 78.

In the embodiment shown in FIG. 25, the sealing membrane 78 does not have a hole for the valve needle 77 to pass through. Rather, the nozzle shut-off tip 79 is integrally formed onto the sealing membrane 78. Here, too, the valve needle 77 is firmly connected to the sealing membrane 78, so that a displacement of the valve needle 77 leads to a corresponding deflection of the sealing membrane 78.

Figure 26:
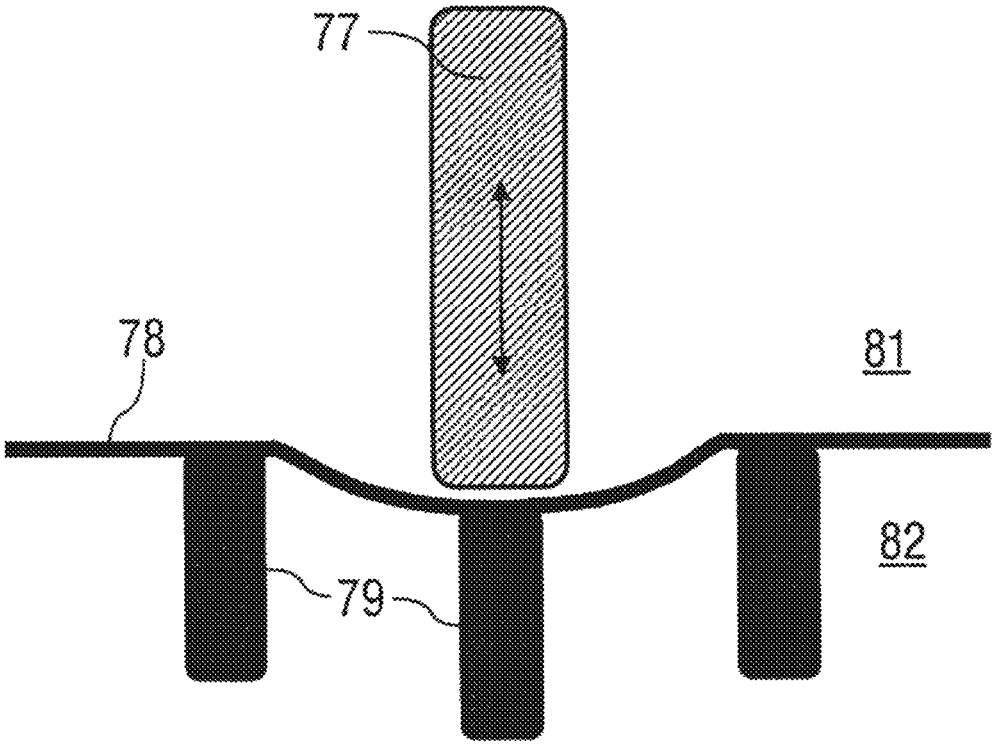

FIG. 26 shows a sealing membrane 78 with integrally nozzle shut-off tips 79. The valve needle 77 can be connected to the sealing membrane 78, but it can also only be attached. In the case of a valve needle 77 only fitted, the opening of the nozzle is caused by the paint pressure. The paint pressure deforms the sealing membrane 78 in the direction of the actuator chamber 81 away from the nozzle chamber 82.

The disclosure is not limited to the preferred embodiments described above. Rather, a large number of variants and modifications are possible, which also make use of the disclosure idea and therefore fall within the scope of protection. In particular, the disclosure also claims protection for the subject-matter and the characteristics of the dependent claims, irrespective of the claims referred to in each case and in particular also without the distinguishing characteristics of the main claim. The disclosure thus encompasses various aspects of the disclosure which enjoy protection independently of each other.

The invention claimed is:

1. An applicator for applying a coating agent to a component, comprising:

a) at least one nozzle row having a plurality of nozzles for dispensing the coating agent in the form of a jet from each nozzle of the plurality of nozzles, the nozzles being arranged along the nozzle row and in a common nozzle plane, the nozzles can each be released or closed by a sliding valve needle, and b) a plurality of actuators for controlled releasing or closing of the nozzles, each actuator of the plurality of actuators having a displaceable actuator needle, c) wherein the individual actuators each have an outer dimension along the nozzle row which is greater than a nozzle distance between adjacent nozzles of the plurality of nozzles along the nozzle row, and d) wherein the actuator needles are each connected to the associated valve needle by a mechanical connecting element that includes at least one of a rocker arm or a lifting beam.

2. The applicator according to claim 1, wherein the actuators are arranged at different distances relative to the associated nozzle in order to enable the nozzle distance between the adjacent nozzles of the plurality of nozzles along the nozzle row.

3. The applicator according to claim 2, wherein the actuators are arranged above one another at different vertical distances from the nozzle plane.

4. The applicator according to claim 3, wherein the actuators are arranged at different horizontal distances from one another relative to the nozzle row.

5. The applicator according to claim 3, wherein the actuators are arranged side by side at equal horizontal distances from the nozzle row.

6. The applicator according to claim 1, wherein a) the actuators are arranged in a plurality of actuator planes, the individual actuator planes running parallel to the nozzle plane, and b) two actuator rows are in each case arranged on either side of the nozzle row in the individual actuator planes, the two actuator rows each containing a plurality of actuators.

7. The applicator according to claim 6, wherein a) at least two actuator planes of the plurality of actuator planes are offset from each other, b) the offset between the at least two of the actuator planes essentially is equal to the nozzle distance between the adjacent nozzles in the nozzle row.

8. The applicator according to claim 6, wherein a) the vertically adjacent actuator planes are offset from each other, b) the offset between the vertically adjacent actuator planes essentially is an integer multiple of the nozzle distance.

9. The applicator according to claim 1, wherein the actuators each have a displaceable actuator needle, the actuator needle forming a valve needle which, depending on its position, releases or closes the associated nozzle.

10. The applicator according to claim 1, wherein a) the applicator has a housing, b) the housing consists of several housing parts, c) one or more of the actuators are provided in at least one of two housing parts, and d) valve needles arranged in parallel are assigned to one of the two housing parts.

11. The applicator in accordance with claim 1, wherein a) the actuators are flushed with a fluid in order to dissipate heat generated during operation, b) the fluid is discharged through at least one of an interior of the housing and an outside of the housing.

12. The applicator according to claim 1, wherein the actuators are connected to valve needles of different lengths as a function of their distance from the nozzle plane, the actuators which are further away from the nozzle plane being connected to a longer valve needle than the actuators which are closer to the nozzle plane.

13. The applicator according to claim 1, wherein the actuators irrespective of their distance from the nozzle plane, all are connected to valve needles of substantially the same length and weight.

14. The applicator according to claim 1, wherein the actuators engage the valve needles at engaging points, and wherein the engaging points are at different distances from the nozzle plane.

15. The applicator according to claim 12, wherein a) the valve needles each have a valve needle tip which tapers conically towards its free end, and b) the individual valve needles each have a separate sealing element at their valve needle tip.

16. The applicator according to claim 1, wherein a) at least one actuator needle closes or releases a plurality of nozzles, and b) the at least one actuator needle is connected to a plurality of valve needles.

17. The applicator according to claim 1, wherein at least one of the actuator needles is connected to a sealing member which closes or opens a plurality of said nozzles.

18. The applicator in accordance with claim 1, wherein a) the individual nozzles are each assigned a valve seat with a separate sealing element, and b) the valve seat is optionally closed or released by a valve needle tip, c) the sealing element in the valve seat is made of metal or semi-metal; and d) the valve needle tip is made of metal or semi-metal.

19. The applicator according to claim 1, wherein a) a valve needle or an actuator needle is acted upon by a return spring, and b) the return spring preloads the valve needle or the actuator needle in an open position or in a closed position.

20. The applicator according to claim 1, wherein a respective position of each of the actuators is adjustable within the applicator.

21. The applicator according to claim 1, wherein a) the individual actuators each have an actuator housing, an armature, a cover and a core made of a magnetic material , and b) the actuator housing is cylindrical, and c) the cover is connected to the actuator housing.

22. The applicator according to claim 1, further comprising the following features:

a) the nozzle distance between the adjacent nozzles is at most 3 mm, b) the adjacent actuators have an actuator distance of at most 3 mm with respect to a longitudinal axis of the valve needles connected to them, c) the nozzles are arranged in a linear nozzle row, d) the actuators are each connected to a displaceable valve needle, the valve needles of all the actuators running parallel to one another, e) the applicator has more than 20 nozzles, f) the applicator has guide means for guiding the individual actuator needles and/or the individual valve needles and thereby preventing buckling or compression of the actuator needles and/or the individual valve needles, g) the individual actuator needles and/or the individual valve needles have a ratio of diameter to length which is smaller than 0.2, h) the individual actuator needles and/or the individual valve needles have a length of 20 mm-500 mm, i) the individual actuator needles and/or the individual valve needles have a stroke of 10 mm-500 mm, j) the valve needle is provided with a corrosion protection coating, k) the actuators operate electromagnetically, piezoelectrically or pneumatically,

1) the actuators have a coil with a number of turns of 10-2000, m) the actuators each have a coil which is wound with a coil wire which has a wire diameter of 0.05 mm-2 mm, n) the coil of the actuators has integrated contact pins for making electrical contact or is connected to the coil wire with an electrical drive, o) the applicator has maximum external dimensions of 550 mm, and p) the applicator has the following connections:

p1) a first supply line for the coating agent, p2) a second supply line for a flushing agent, p3) a third supply line for compressed air, and p4) a return line.

23. A coating robot with an applicator according to claim 1.

24. The coating robot according to claim 23, wherein the applicator is exchangeably fastened to the coating robot.

* * * * *